US006397531B1

(12) United States Patent
Martin

(10) Patent No.: US 6,397,531 B1
(45) Date of Patent: Jun. 4, 2002

(54) CEILING DISPLAY SYSTEM

(76) Inventor: Daniel R. Martin, 20448 Collier Dr., Strongsville, OH (US) 44136

( * ) Notice: Subject to any disclaimer, the term of this patent is extended or adjusted under 35 U.S.C. 154(b) by 0 days.

(21) Appl. No.: 09/669,077

(22) Filed: Sep. 25, 2000

(51) Int. Cl.[7] ..... E04C 2/52

(52) U.S. Cl. ..... 52/220.6; 52/39; 52/202; 40/611; 40/617; 40/553

(58) Field of Search ..... 52/38, 39, 27, 52/144, 220.6, 220.8; 40/553, 559, 612, 617, 611

(56) References Cited

U.S. PATENT DOCUMENTS

| | | | | |
|---|---|---|---|---|
| 3,201,579 A | | 8/1965 | Harper | |
| 3,460,299 A | | 8/1969 | Wilson | |
| 3,974,584 A | | 8/1976 | Shorette | |
| 4,075,775 A | | 2/1978 | Shorette | |
| 4,229,913 A | | 10/1980 | Corrigan | |
| 4,290,218 A | | 9/1981 | Drueck, Jr. | |
| 4,528,764 A | * | 7/1985 | Cobb | 40/553 |
| 4,947,570 A | * | 8/1990 | May et al. | 40/553 |
| 5,044,103 A | * | 9/1991 | Izenberg | 40/617 |
| 6,014,841 A | * | 1/2000 | McCoy et al. | 52/19 |

* cited by examiner

*Primary Examiner*—Carl D. Friedman
*Assistant Examiner*—Yvonne M. Horton
(74) *Attorney, Agent, or Firm*—David A. Burge

(57) ABSTRACT

Relatively thin collectibles such as movie posters and sports jerseys, as well as relatively thin works of art and the like are displayed through transparent bottom wall regions of relatively thin protective enclosures that are sized the same as and substituted for selected ceiling tile in a suspended ceiling. Each of the protective enclosures has a top wall that overlies at least a transparent region of the enclosure's bottom wall. Preferably the protective enclosures are generally square or rectangular to correspond with the size and shape of the ceiling tile they replace, and have top and bottom walls that extend substantially the full widths and lengths of the enclosures for being connected near their perimeters to cooperate directly or with short upstanding side walls to define thin display compartments that are closed to minimize the circulation of ambient air therethrough for protectively housing collectibles that are to be displayed through transparent central regions of the bottom walls. Provision is made for the bottom and top walls of the enclosures to be separated when access is needed to the display compartments for display changes and cleaning.

32 Claims, 4 Drawing Sheets

CEILING DISPLAY SYSTEM

BACKGROUND OF THE INVENTION

1. Field of the Invention

The present invention relates to relatively flat protective enclosures having bottom walls with transparent central regions for displaying relatively thin collectible articles, works of art and the like by substituting the display enclosures for selected ceiling tile of the same size in the gridwork of a suspended ceiling. In preferred practice, the present invention relates to the provision and use of generally square or rectangular protective enclosures that match the generally square or rectangular ceiling tile panels of a suspended ceiling, wherein the enclosures have bottom walls with at least central regions thereof being transparent, and non-transparent top walls that cover at least the transparent central regions of the bottom walls to permit relatively flat articles to be protectively housed in spaces defined between the bottom and top walls for being displayed by substituting the enclosures for selected ones of the ceiling tile panels so as to be supported by the gridwork of the suspended ceiling.

2. Prior Art

Suspended ceilings have come into wide use not only in sizable rooms of public buildings but also in business offices and finished basements of fine homes. Such ceilings usually include a gridwork of metal members referred to as "grid bars" that are configured to engage peripheral portions of ceiling tile panels to support the ceiling tile panels to extend substantially within a common plane of the ceiling. The grid bars usually include a first set of parallel extending bars that run between opposite end walls of a generally rectangular room, and a second set of parallel extending bars that run between opposite side walls of the room. The grid bars of the first and second sets intersect perpendicularly to define substantially square or rectangular openings that are populated by generally square or rectangular ceiling tile. Central regions of suspended ceilings of this type usually have grid squares or rectangles of a uniform size that are populated by ceiling tile of a corresponding uniform size.

In a suspended ceiling of the type described, the grid bars often have cross-sections that take the shape of an inverted letter "T." The cross-bar of each inverted "T" extends substantially horizontally to define upwardly facing flange surfaces located on opposite sides of the stem of the "T." These upwardly facing flange surfaces underlie peripheral portions of the ceiling tile panels to effectively "perimetrically support" the ceiling tile panels with their bottom surfaces preferably extending substantially within a common plane.

While suspended ceilings of this type frequently are found in public buildings such as galleries, in business offices, and in recreation rooms of fine homes where wall surfaces often are utilized to mount displays of relatively thin collectibles or works of art such as pictures, paintings, plaques, movie posters, banners, sports jerseys, and other collectibles, memorabilia or works of art, little use tends to be made of the large, blank surface areas of the ceilings of these rooms—where similar articles of interest also could be displayed. Putting prized possessions "up there" where cigar and cigarette smoke and other pollutants may linger and collect just has not been an obvious step to take even though the availability of the sizable areas of ceilings for use as display surfaces has long been recognized.

As a result, while it is common enough to see a variety of temporarily hung banners, wind chimes and other kinds of decorative articles suspended by strings, wires and hooks from the grid bars of suspended ceilings; and while posters are sometimes found temporarily taped, tacked or pinned to the grid bars or tile panels of a suspended ceiling overlying the chairs and examination tables of dentists and doctors where patients are asked to lie on their backs during dental and medical procedures; about all of a more permanent nature that the grid bars of suspended ceilings are commonly utilized to support are "exit" signs or informational signs of the type found in drug stores, super markets and discount stores that are provided not as a "display" but rather to guide customers to goods they desire to purchase.

Valuable collectibles such as unique football jerseys, vintage original movie posters, artwork such as paintings and the like have not, until now, been supportable "up there" in the gridwork of a suspended ceiling in a protectively enclosed manner that ensures preservation of integrity and maintenance of the value of such articles while also providing for their safe display.

SUMMARY OF THE INVENTION

The present invention addresses the foregoing and other needs and drawbacks of the prior art by providing relatively thin protective enclosures for containing and supporting relatively flat collectibles, works of art, and the like by positioning such articles in the thin enclosures so that the articles can be viewed through transparent bottom walls of the enclosures when the enclosures are substituted for selected ceiling tile panels of a suspended ceiling.

A feature of the present invention resides in the provision and use of protective enclosures that are "closed" or otherwise constructed so as to minimize the circulation of ambient air (and the pollutants it may contain) through the display compartments where valued collectibles or works of art and the like may be positioned for display. Top and bottom wall members of the protective enclosures cooperate with each other, preferably at their peripheries, to define closed display compartments that can be accessed by effecting relative movement of the top and bottom wall members when access is needed to accommodate display changes and cleaning.

In accordance with one aspect of the present invention a method of and means are provided for protectively displaying a relatively lightweight, relatively flat article in a room having a ceiling that is defined at least in part by a grid of support members that provide upwardly facing support surfaces that extend perimetrically about generally rectangular openings for underlying and supporting peripheral portions of generally rectangular ceiling tile sized to fit the openings. A particular one of the ceiling tile panels is selected to be replaced by a display container of corresponding size, and is removed from the ceiling. A relatively thin display enclosure is provided that has a bottom wall that defines a transparent window through which contents of the display enclosure can be viewed, and a top wall that overlies at least the region of the transparent window so that an article that is inserted therebetween will be protectively sandwiched by the top and bottom walls while being displayed for view through the transparent window. The display enclosure is substituted for the removed ceiling tile panel, with peripheral portions of the display enclosure being supported by the grid that previously supported the selected ceiling tile.

BRIEF DESCRIPTION OF THE DRAWINGS

Other features and a fuller understanding of the invention may be had by referring to the following description and claims taken in conjunction with the accompanying drawings, wherein:

DESCRIPTION OF THE PREFERRED EMBODIMENT

Figure 1:
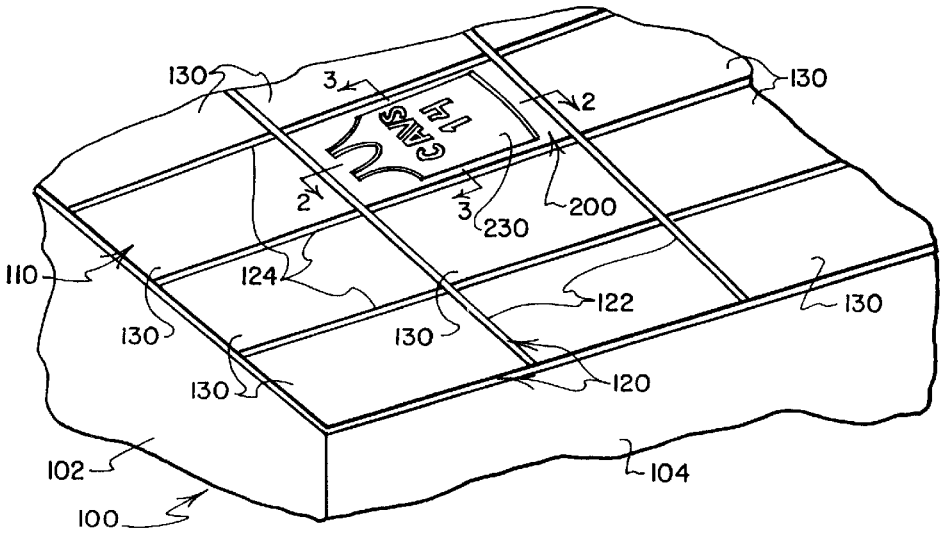
FIG. 1 is a perspective view of portions of two walls and a suspended ceiling of a room, with a protective enclosure embodying one form of preferred practice of the present invention being substituted for a selected one of the ceiling tile panels of the suspended ceiling for displaying a basketball jersey contained therein.

Referring to FIG. 1, portions of two perpendicularly extending walls of a room 100 having a suspended ceiling 110 are indicated by the numerals 102, 104. The ceiling 110 includes a gridwork 120 defined by a first set of substantially equally spaced, parallel extending grid bars 122 that extend substantially parallel to the wall 102, and by a second set of substantially equally spaced, parallel extending grid bars 124 that extend substantially parallel to the wall 104. Because the equally spaced grid bars 122 intersect the equally spaced grid bars 124 at substantially right angles, substantially equally sized square or rectangular spaces are defined between intersecting adjacent pairs of the grid bars 122, 124. Generally square or rectangular ceiling tile panels 130 of substantially uniform size are used to fill the substantially equally sized square or rectangular spaces between adjacent pairs of the grid bars 122, 124.

Figure 2:
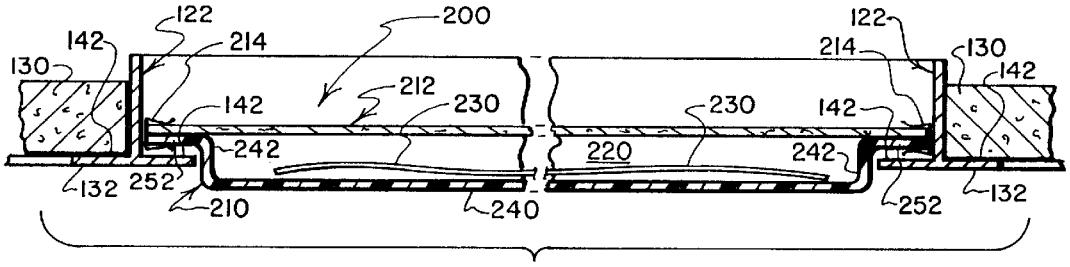
FIG. 2 is a foreshortened sectional view on an enlarged scale, as seen from a plane indicated by a line 2—2 in FIG. 1 showing portions of the protective enclosure, portions of the basketball jersey housed within the protective enclosure, portions of two grid bars of the suspended ceiling, and portions of two adjacent ceiling tile panels of the suspended ceiling.
Figure 3:
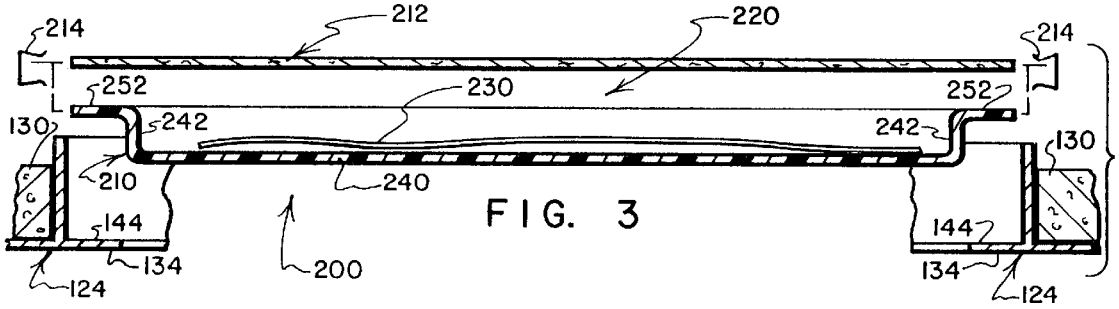
FIG. 3 is an exploded sectional view on the same scale as FIG. 2, as seen from a plane indicated by a line 3—3 in FIG. 1.

Referring to FIGS. 2 and 3, the grid bars 122, 124 are of substantially uniform, inverted T-shaped cross-section, with "cross-bars" 132, 124 of the inverted T-shaped cross-sections providing upwardly facing flange surfaces 142, 144, respectively, that underlie peripheral portions of the ceiling tile panels 130 so as to "perimetrically support" the ceiling tile panels 130.

Referring to FIGS. 1–3, a protective enclosure that embodies one form of the preferred practice of the present invention is indicated generally by the numeral 200. The protective enclosure is of generally square or rectangular shape, having substantially the same size as one of the ceiling tile panels 130. As is seen in FIGS. 2 and 3, peripheral portions of the protective enclosure 200 reside atop the upwardly facing flange surfaces 142, 144 of the grid bars 122, 124, respectively, so that the protective enclosure 200 is "perimetrically supported" in substantially the same manner as the ceiling tile panels 130.

Referring to FIGS. 2 and 3, the protective enclosure embodiment 200 depicted in FIGS. 1–3 is formed by a bottom wall member 210 and a top wall member 212 of substantially the same size that are held together by fasteners that take the form of U-shaped spring clips 216 positioned at spaced locations along the peripheries (i.e., at spaced locations along the perimeters of) the overlying top and bottom wall members 210, 212. The perimetrically clipped-together top and bottom wall members 210, 212 cooperate to define an enclosed display space or display compartment 220 within which a relatively lightweight, relatively thin collectible article such as a basketball jersey 230 can be positioned for display.

A feature of the display enclosure embodiment 200 depicted in FIGS. 2 and 3 is that the bottom wall member 210 has a lowered central region 240 that is connected by upstanding sidewall portions 242 to an integrally formed, continuously perimetrically extending flange portion 252 that, together with the spring clips 216, overlies and rests atop the upwardly facing flange surfaces 132, 134 of the grid bars 122, 124, respectively. The depending central region 240 extends in a plane spaced from but extending substantially parallel to a common plane occupied by the perimetrically extending flange portion 252. This arrangement gives the enclosed display space 200 sufficient thickness (between the top and bottom wall panels 210, 212) to enable the displayed jersey 230 to be folded or otherwise positioned for display in a suitable manner.

In preferred practice, the bottom wall panel 210 is transparent—or at least a central portion of the depending central region 240 is transparent—to permit contents of the enclosed display space or compartment 220 to be viewed therethrough. In contrast, the top wall panel 212 is non-transparent, preferably opaque, so that ceiling structure located above the protective enclosure 200 will not be viewable through transparent portions of the bottom wall panel 210.

Figure 4:
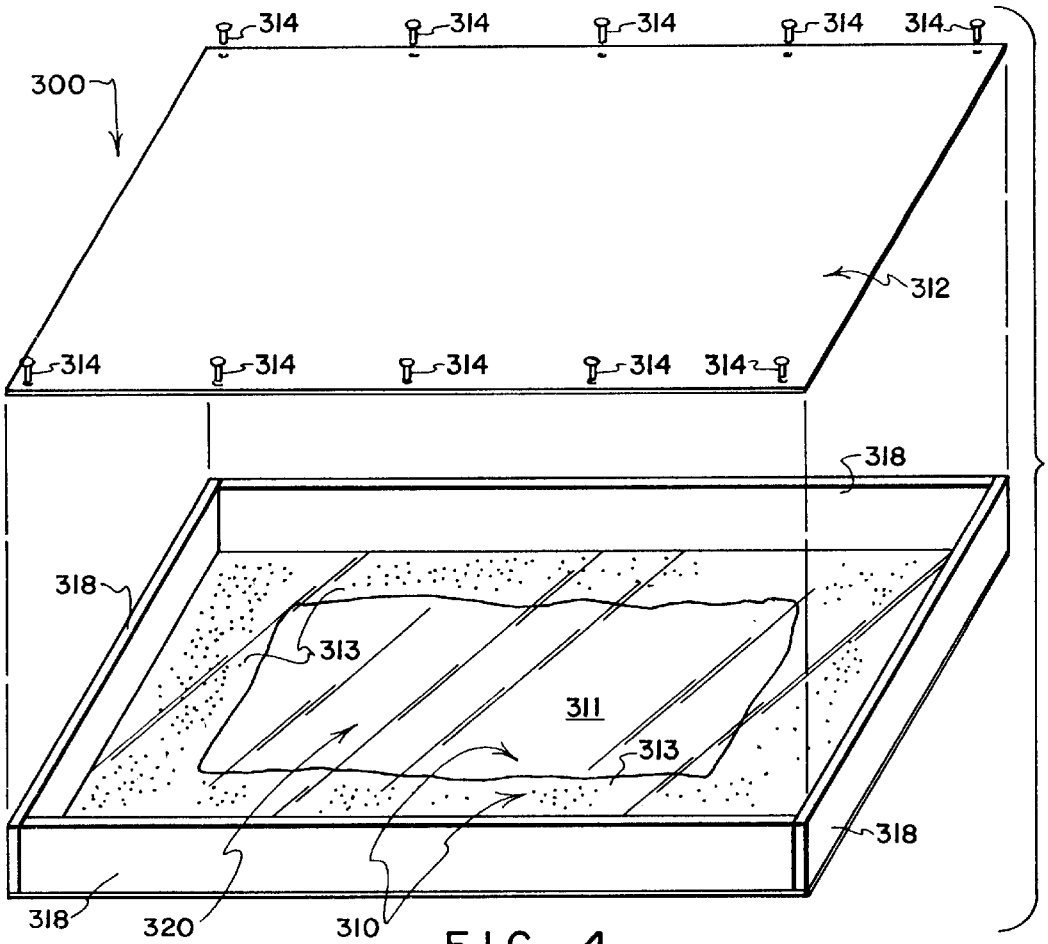
FIG. 4 is an exploded perspective view showing an alternate form of protective enclosure, with a top wall panel thereof separated from side walls and a bottom wall panel thereof, and with the bottom wall panel depicted as having a frosted peripheral region that surrounds a transparent central region.
Figure 5:
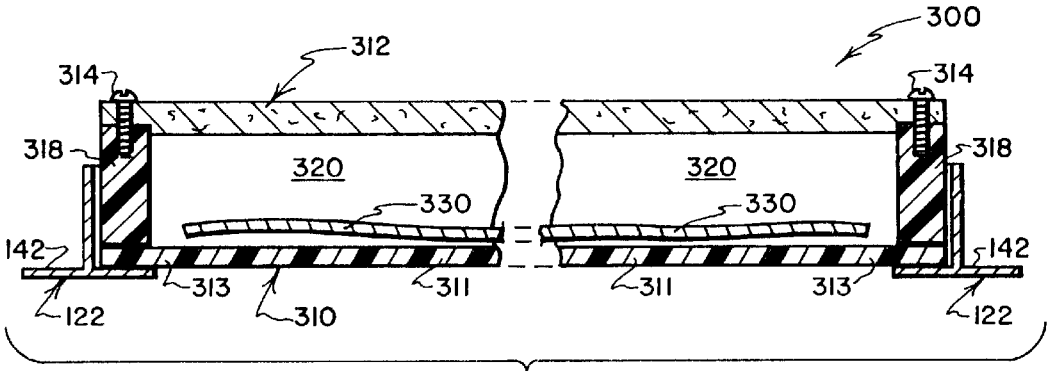
FIG. 5 is a foreshortened sectional view similar to FIG. 2 but showing the protective enclosure of FIG. 4 containing a thin work of art positioned centrally therein for display.

Referring to FIGS. 4 and 5, an alternate form of protective enclosure 300 is depicted that provides a thicker, longer and wider enclosed display space or display compartment 320 for housing an article 330 (see FIG. 5) to be displayed. The enclosure 300 includes a substantially flat bottom wall panel 310, a substantially flat top wall panel 312, and upstanding side walls 318 that are bonded to perimetrically extending portions of the bottom wall panel 310 and are connected by fasteners such as screws 314 to peripheral or perimetrically extending portions of the top wall panel 312. A central region 311 of the bottom wall panel 310 is transparent, while a border or peripheral region 313 that surrounds the central region 311 is frosted or translucent. The top wall panel 312 preferably is non-transparent, preferably opaque—although the top wall panel 312 can be frosted or otherwise coated, configured or formed so as to not be of a see-through nature.

Figure 6:
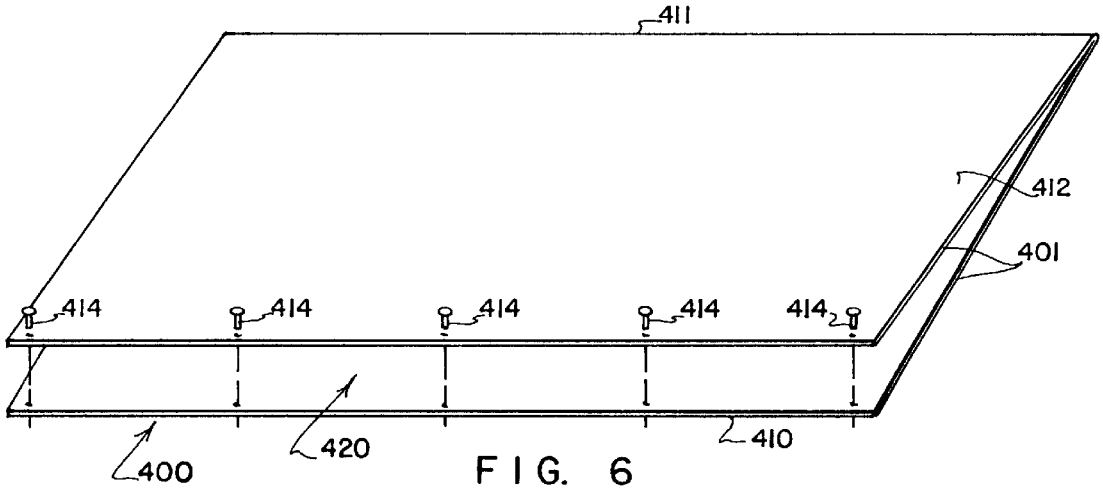
FIG. 6 is a perspective view of showing still another alternate form of protective enclosure formed by a folded piece of plastic material that can be held closed by screws.

Referring to FIG. 6, another form of protective enclosure is indicated generally by the numeral 400. The enclosure 400 is defined by a folded-over sheet of plastics material 401 that preferably is formed so as to provide a bottom wall member 410 that is transparent, and a top wall member 412 that is non-transparent, preferably opaque. A fold 411 of the sheet 401 defines something of an "axis" about which the bottom and top wall members 410, 412 can be moved in something of a "pivotal" type of relative movement to provide access to the space therebetween. Stated in another way, the sheet 410 has a certain degree of flexibility which enables the bottom and top wall members 410 to be moved relative to each other to "open" and "close" the display space or compartment 420 located therebetween. Fasteners such as screws 414 may be used to hold the members 410, 412 closed.

The enclosure 400 principally is suited to receive, support and display a thin single sheet of paper, or other article that is sufficiently thin so that overlying peripheral portions of the bottom and top wall members 410, 412 will substantially engage each other when fasteners such as screws 414 are tightened in place—so that the very thin space 420 within which a sheet of paper or other thin article is enclosed will effectively be "closed" or kept so thin as to largely prevent the circulation of ambient air therethrough when the protective enclosure is substituted for a ceiling tile in the gridwork of a suspended ceiling.

Figure 7:
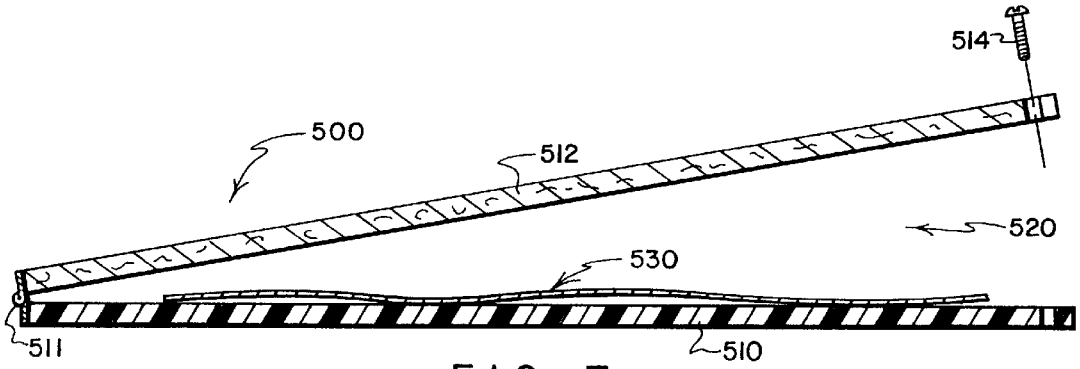
FIG. 7 is a sectional view showing a protective enclosure similar to the one depicted in FIG. 6, but utilizing a typical piano hinge to connect top and bottom wall panels thereof, and showing a thin work of art positioned between the top and bottom wall panels.
Figure 8:
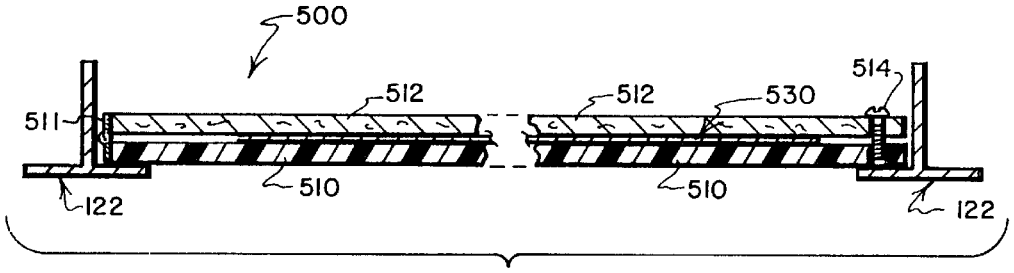
FIG. 8 is a foreshortened sectional view similar to FIG. 2 but showing the protective enclosure of FIG. 7 closed and supported by a pair of grid bars of a suspended ceiling to display the work of art through the transparent bottom wall panel.

Referring to FIGS. 7 and 8, another form of "hinged" protective enclosure 500 is depicted—which actually employs a mechanical hinge 511 to connect a pair of overlying edge regions of its bottom and top wall members 510, 512. Fasteners such as screws 514 are employed to keep at least one of the other pairs of overlying edge regions of the bottom and top wall members 510, 512 in closely overlying (preferably "engaging") relationship when a thin article 530 is positioned in the display space 520 located between the bottom and top wall members 510, 512.

In the embodiments 400, 500, the bottom wall members 410, 510 preferably are transparent or have at least central regions that are transparent, and the top wall members 412, 512 are non-transparent, preferably opaque.

Figure 9:
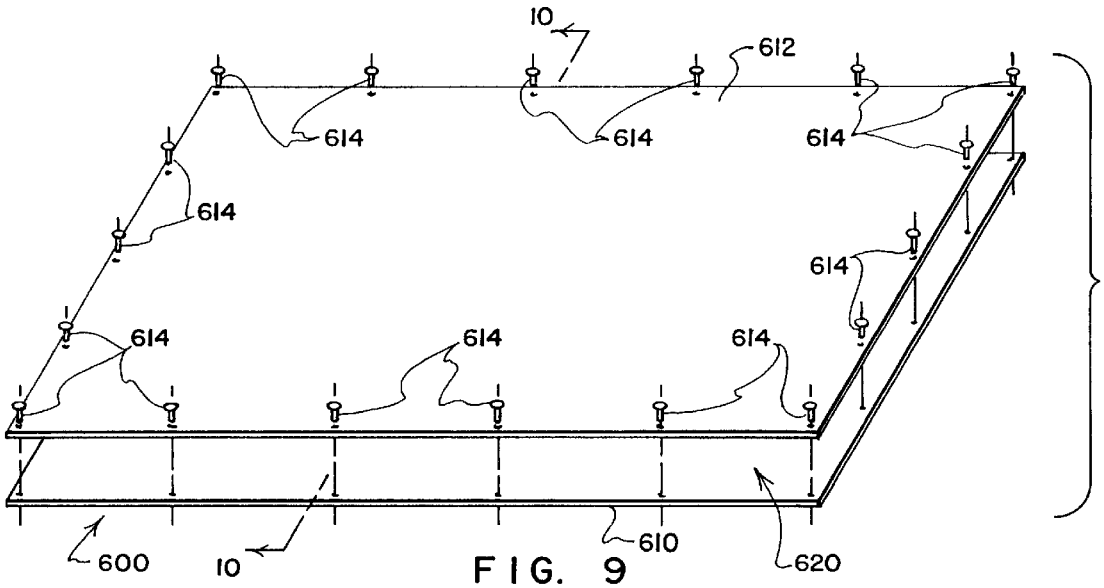
FIG. 9 is an exploded perspective view showing still another form of protective enclosure that utilizes screws to releasably connect top and bottom wall panels.

Referring to FIG. 9, still another alternate protective enclosure embodiment is indicated generally by the numeral 600. The enclosure 600 is quite simply comprised of flat bottom and top wall members 610, 612 that are held together at spaced locations by fasteners such as screws 614 installed in aligned holes formed in overlying peripheral portions of the wall members 610, 612 surrounding a display space 620 located between the members 610, 612.

Figure 10:
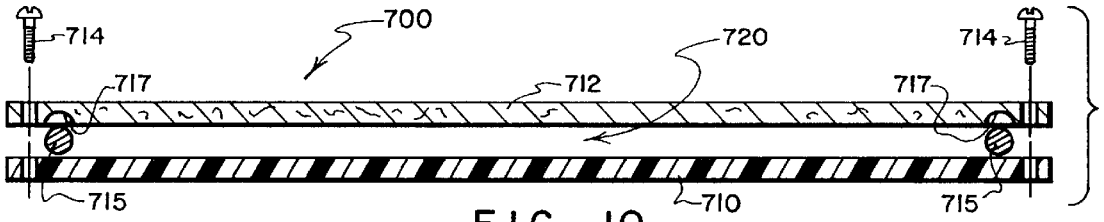
FIG. 10 is a sectional view thereof, as seen from a plane indicated by a line 10—10 in FIG. 9, with a compressible resilient seal inserted between peripheral regions of the top and bottom wall panels, and with a concave groove being defined in the bottom surface of the top panel for receiving portions of the seal; and, FIG. 11 is a foreshortened sectional view similar to FIG. 2 but showing the enclosure of FIGS. 9 and 10 supported by a pair of grid bars of a suspended ceiling for displaying a thin article positioned between the top and bottom wall panels within a display compartment surrounded by the compressed resilient seal.
Figure 11:
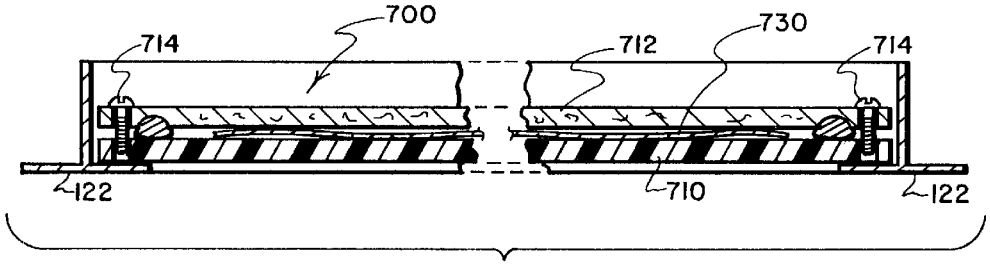

Referring to FIG. 10, a modification of the enclosure shown in FIG. 9 is indicated generally by the numeral 700. The enclosure 700 includes flat bottom and top wall members 710, 712 connected at spaced peripheral locations by screws 714. As is shown in FIG. 10, at least one of the members 710, 712 may be provided with a concave groove 717 for receiving portions of a seal or gasket 715 that extends perimetrically about a space or compartment 720 within which a collectible or other flat article 730 (see FIG. 11) can be positioned for display. As is shown in FIG. 11, when tile screws 714 are tightened in place, they force the members 710, 712 toward each other so as to compress the resilient seal or gasket 715 to seal the space or compartment 720 with a collectible 730 housed therein for display when the protective enclosure 800 is substituted for a ceiling tile panel of a suspended ceiling.

Method aspects of the present invention utilize protective display enclosures of the type disclosed herein that are substituted for one or more of the ceiling tile of a suspended ceiling to display relatively lightweight, relatively thin articles through transparent bottom windows of the enclosures while supporting the articles being displayed in display spaces or compartments that preferably are closed to minimize the circulation therethrough of ambient air and the pollutants it may contain.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. Several features of the invention are brought out in some detail in the claims that follow, which complete the disclosure. It is intended that the patent shall cover, by suitable expression in the appended claims, whatever features of patentable novelty exist in the invention disclosed.

What is claimed is:

1. A protective enclosure for displaying relatively thin, relatively lightweight articles in a suspended ceiling of the type having ceiling tile of a predetermined size supported along the perimeters of the ceiling tile by a suspended gridwork of intersecting grid bars that cooperate to define openings which are populated by the ceiling tile, comprising:

a) a bottom wall member having at least a central region that is transparent, and a peripheral region that extends perimetrically about the central region, wherein the peripheral region is sized to permit the bottom wall member to be substituted for a selected one of the ceiling tile so that the bottom wall member is supported in the peripheral region thereof by the gridwork of the suspended ceiling, with the transparent central region of the bottom wall member providing a window through which an article to be displayed is viewable when the article is in a display position atop the bottom wall member;

b) a top wall member having a central region sized to overlie at least 1) the transparent central region of the bottom wall member and 2) the article to be viewed when the article to be viewed is stationed in the display position atop the bottom wall member, and having a peripheral region that extends perimetrically about the central region of the top wall member;

c) means for releasably connecting the peripheral region of the top wall member with the peripheral region of the bottom wall member 1) for supporting the top wall member so that the central region of the top wall member cooperates with the central region of the bottom wall member to define a display space therebetween of sufficient size to permit the article to be viewed to be stationed in the display position, 2) for permitting relative movement between the top wall member and the bottom wall member, and 3) for cooperating with the peripheral regions of the bottom and top wall members to minimize the flow of ambient air through the display space when the peripheral region of the top wall member is connected to the peripheral region of the bottom wall member with the article to be displayed being stationed in the display position.

2. A protective enclosure for displaying relatively thin, relatively lightweight articles in a suspended ceiling of the type having ceiling tile of a predetermined size supported along the perimeters of the ceiling tile by a suspended gridwork of intersecting grid bars that cooperate to define openings which are populated by the ceiling tile, comprising:

a) a bottom wall member having at least a central region that is transparent, and a peripheral region that extends perimetrically about the central region, wherein the peripheral region is sized to permit the bottom wall member to be substituted for a selected one of the ceiling tile so that the bottom wall member is supported in the peripheral region thereof by the gridwork of the suspended ceiling, with the transparent central region of the bottom wall member providing a window through which an article to be displayed is viewable when the article is in a display position atop the bottom wall member;

b) a top wall member having a central region sized to overlie at least 1) the transparent central region of the bottom wall member and 2) the article to be viewed when the article to be viewed is stationed in the display position atop the bottom wall member, and having a peripheral region that extends perimetrically about the central region of the top wall member;

c) means for releasably connecting the peripheral region of the top wall member with the peripheral region of the bottom wall member for supporting the top wall member so that the central region of the top wall member cooperates with the central region of the bottom wall member to define a display space therebetween of sufficient size to permit the article to be viewed to be stationed in the display position, and for cooperating with the peripheral regions of the bottom and top wall members to minimize the flow of ambient air through the display space when the peripheral region of the top wall member is connected to the peripheral region of the bottom wall member with the article to be displayed being stationed in the display position; and, d) wherein the means for releasably connecting the peripheral region of the top wall member with the peripheral region of the bottom wall member includes fastening means for clamping toward each other the peripheral regions of the bottom and top wall members.

3. The protective enclosure of claim 2 wherein the means for releasably connecting the peripheral region of the top wall member with the peripheral region of the bottom wall member includes means bridging a space between the peripheral regions of the bottom and top wall members.

4. The protective enclosure of claim 3 wherein the means for bridging a space includes resilient sealing means interposed between the peripheral regions of the bottom and top wall members, and fastening means for clamping toward each other the peripheral regions of the bottom and top wall members so as to compress the resilient sealing means.

5. The protective enclosure of claim 2 wherein at least a selected portion of the top wall member is non-transparent.

6. The protective enclosure of claim 5 wherein the selected portion of the top wall member is opaque.

7. A protective enclosure for displaying relatively thin, relatively lightweight articles in a suspended ceiling of the type having ceiling tile of a predetermined size supported along the perimeters of the ceiling tile by a suspended gridwork of intersecting grid bars that cooperate to define openings which are populated by the ceiling tile, comprising:

a) a bottom wall member having at least a central region that is transparent, and a peripheral region that extends perimetrically about the central region, wherein the peripheral region is sized to permit the bottom wall member to be substituted for a selected one of the ceiling tile so that the bottom wall member is supported in the peripheral region thereof by the gridwork of the suspended ceiling, with the transparent central region of the bottom wall member providing a window through which an article to be displayed is viewable when the article is in a display position atop the bottom wall member;

b) a top wall member having a central region sized to overlie at least 1) the transparent central region of the bottom wall member and 2) the article to be viewed when the article to be viewed is stationed in the display position atop the bottom wall member, and having a peripheral region that extends perimetrically about the central region of the top wall member;

c) means for releasably connecting the peripheral region of the top wall member with the peripheral region of the bottom wall member for supporting the top wall member so that the central region of the top wall member cooperates with the central region of the bottom wall member to define a display space therebetween of sufficient size to permit the article to be viewed to be stationed in the display position, and for cooperating with the peripheral regions of the bottom and top wall members to minimize the flow of ambient air through the display space when the peripheral region of the top wall member is connected to the peripheral region of the bottom wall member with the article to be displayed being stationed in the display position; and, d) wherein the means for releasably connecting the peripheral region of the top wall member with the peripheral region of the bottom wall member includes means for permitting the top wall member and the bottom wall member to move relatively toward and away from each other.

8. The protective enclosure of claim 7 wherein the means for releasably connecting the peripheral region of the top wall member with the peripheral region of the bottom wall member includes means bridging a space between the peripheral regions of the bottom and top wall members.

9. The protective enclosure of claim 8 wherein the means for bridging a space includes resilient sealing means interposed between the peripheral regions of the bottom and top wall members, and fastening means for clamping toward each other the peripheral regions of the bottom and top wall members so as to compress the resilient sealing means.

10. The protective enclosure of claim 7 wherein at least a selected portion of the top wall member is non-transparent.

11. The protective enclosure of claim 10 wherein the selected portion of the top wall member is opaque.

12. A protective enclosure for displaying relatively thin, relatively lightweight articles in a suspended ceiling of the type having ceiling tile of a predetermined size supported along the perimeters of the ceiling tile by a suspended gridwork of intersecting grid bars that cooperate to define openings which are populated by the ceiling tile, comprising:

a) a bottom wall member having at least a central region that is transparent, and a peripheral region that extends perimetrically about the central region, wherein the peripheral region is sized to permit the bottom wall member to be substituted for a selected one of the ceiling tile so that the bottom wall member is supported in the peripheral region thereof by the gridwork of the suspended ceiling, with the transparent central region of the bottom wall member providing a window through which an article to be displayed is viewable when the article is in a display position atop the bottom wall member;

b) a top wall member having a central region sized to overlie at least 1) the transparent central region of the bottom wall member and 2) the article to be viewed when the article to be viewed is stationed in the display position atop the bottom wall member, and having a peripheral region that extends perimetrically about the central region of the top wall member;

c) means for releasably connecting the peripheral region of the top wall member with the peripheral region of the bottom wall member for supporting the top wall member so that the central region of the top wall member cooperates with the central region of the bottom wall member to define a display space therebetween of sufficient size to permit the article to be viewed to be stationed in the display position, and for cooperating with the peripheral regions of the bottom and top wall members to minimize the flow of ambient air through the display space when the peripheral region of the top wall member is connected to the peripheral region of the bottom wall member with the article to be displayed being stationed in the display position;

d) wherein the means for releasably connecting the peripheral region of the top wall member with the peripheral region of the bottom wall member includes means for bridging a space between the peripheral regions of the bottom and top wall members, and wherein the means for bridging a space includes resilient sealing means interposed between the peripheral regions of the bottom and top wall members, and fastening means for clamping toward each other the peripheral regions of the bottom and top wall members so as to compress the resilient sealing means.

13. The protective enclosure of claim 12 wherein at least a selected portion of the top wall member is non-transparent.

14. The protective enclosure of claim 13 wherein the selected portion of the top wall member is opaque.

15. A protective enclosure for displaying relatively thin, relatively lightweight articles in a suspended ceiling of the type having ceiling tile of a predetermined size supported along the perimeters of the ceiling tile by a suspended gridwork of intersecting grid bars that cooperate to define openings which are populated by the ceiling tile, comprising:

a) a bottom wall member having at least a central region that is transparent, and a peripheral region that extends perimetrically about the central region, wherein the peripheral region is sized to permit the bottom wall member to be substituted for a selected one of the ceiling tile so that the bottom wall member is supported in the peripheral region thereof by the gridwork of the suspended ceiling, with the transparent central region of the bottom wall member providing a window through which an article to be displayed is viewable when the article is in a display position atop the bottom wall member;

b) a top wall member having a central region sized to overlie at least 1) the transparent central region of the bottom wall member and 2) the article to be viewed when the article to be viewed is stationed in the display position atop the bottom wall member, and having a peripheral region that extends perimetrically about the central region of the top wall member;

c) means for releasably connecting the peripheral region of the top wall member with the peripheral region of the bottom wall member for supporting the top wall member so that the central region of the top wall member cooperates with the central region of the bottom wall member to define a display space therebetween of sufficient size to permit the article to be viewed to be stationed in the display position, and for cooperating with the peripheral regions of the bottom and top wall members to minimize the flow of ambient air through the display space when the peripheral region of the top wall member is connected to the peripheral region of the bottom wall member with the article to be displayed being stationed in the display position; and, d) wherein the top wall member and the bottom wall member are configured such that the peripheral region of the top wall member extends in a common top plane that parallels and overlies a common bottom plane in which the peripheral region of the bottom wall member extends, and the peripheral regions of the top and bottom wall members overlie the gridwork of the suspended ceiling so as to be supported by the gridwork when the protective enclosure is substituted for the selected one of the ceiling tile.

16. The protective enclosure of claim 15 wherein the central region of a selected one of the top and bottom wall members extends out of a the common plane of the peripheral region of the selected one of the top and bottom wall member.

17. The protective enclosure of claim 15 wherein at least a selected portion of the top wall member is non-transparent.

18. The protective enclosure of claim 17 wherein the selected portion of the top wall member is opaque.

19. A generally rectangular protective enclosure sized to permit the enclosure to be substituted for a generally rectangular ceiling tile in a suspended ceiling, having a generally rectangular bottom wall member that defines a substantially transparent window through which an article to be displayed is viewable when in a display position atop the bottom wall, and having a top wall member configured to overlie the article to be displayed when in the display position to define a display space between central regions of the top and bottom wall members, and means for cooperating with the top and bottom wall members in peripheral regions of the top and bottom wall members that surround the central regions of the top and bottom wall members to connect the peripheral regions of the top and bottom wall members, to bridge a space between the peripheral regions of the top and bottom wall members, and to minimize the flow of ambient air through the display space.

20. A generally rectangular protective enclosure sized to permit the enclosure to be substituted for a generally rectangular ceiling tile in a suspended ceiling, having a generally rectangular bottom wall member that defines a substantially transparent window through which an article to be displayed is viewable when in a display position atop the bottom wall, and having a top wall member configured to overlie the article to be displayed when in the display position to define a display space between central regions of the top and bottom wall members, and means for cooperating with the top and bottom wall members in regions of the top and bottom wall members that surround the central regions of the top and bottom wall members to connect the top and bottom wall members and to minimize the flow of ambient air through the display space; and wherein the means for cooperating with the top and bottom wall members includes fastening means for releasably connecting peripheral regions of the top and bottom wall members that extend about the central regions of the top and bottom wall members.

21. The protective enclosure of claim 20 wherein the means for releasably connecting peripheral regions includes means for permitting the top wall member and the bottom wall member to pivot relatively toward and away from each other.

22. The protective enclosure of claim 20 wherein the means for releasably connecting peripheral regions includes means for bridging a space between the peripheral regions of the bottom and top wall members.

23. The protective enclosure of claim 22 wherein the means for bridging a space includes resilient sealing means interposed between the peripheral regions of the bottom and top wall members, and fastening means for clamping toward each other the peripheral regions of the bottom and top wall members so as to compress the resilient sealing means therebetween.

24. The protective enclosure of claim 22 wherein the the means for bridging a space includes structure defining an upstanding sidewall that bridges the space, and fastening means for releasably connecting at least a selected one of the peripheral region of the bottom wall member and the peripheral region of the top wall member to the sidewall.

25. The protective enclosure of claim 20 wherein at least a selected one of the top member and bottom wall members has the peripheral regions thereof extending in a common first plane, and the central region thereof extends in a second plane spaced from and substantially paralleling the first plane.

26. The protective enclosure of claim 20 wherein the central region of a selected one of the top and bottom wall members extends out of a common plane that is occupied by the peripheral region of the selected one of the top and bottom wall members.

27. The protective enclosure of claim 20 wherein at least a selected portion of the top wall member is non-transparent.

28. The protective enclosure of claim 27 wherein the selected portion of the top wall member is opaque.

29. In combination with a suspended ceiling of the type having ceiling tile supported by a suspended gridwork, a protective enclosure having a bottom wall member and a top wall member that overlies and cooperates with the bottom wall member to define a display space located centrally therebetween, having means for releasably connecting overlying peripheral portions of the bottom and top wall members for fully closing the display space to the circulation of ambient air therethrough, wherein the bottom wall member defines a window through which an article positioned in the display space is viewable, and with the protective enclosure being sized to permit the enclosure to be substituted for a selected one of the ceiling tile in the suspended ceiling for displaying the article through the window of the bottom wall member.

30. A method of displaying an article, comprising the steps of:

a) providing a protective enclosure having a bottom wall member and a top wall member that overlies and cooperates with the bottom wall member to define a display space located centrally therebetween, having means for releasably connecting overlying peripheral portions of the bottom and top wall members for permitting the top and bottom wall members to be moved apart to open the display space so that the article is insertable into and removed from the display space, and for engaging said overlying peripheral portions of the bottom and top wall members to close the display space to the circulation of ambient air therethrough, wherein the bottom wall member defines a window through which an article positioned in the display space can be viewed, and with the protective enclosure being sized to permit it to be substituted for a selected ceiling tile in a suspended ceiling for displaying the article through the window of the bottom wall member;

b) opening the display space and positioning the article in the display space defined between the bottom and top wall members of the protective enclosure;

c) closing the display space to the circulation of ambient air therethrough; and, d) substituting the protective enclosure containing the article in the display space thereof for the selected ceiling tile in the suspended ceiling so that the article is viewable through the window of the bottom wall member.

31. A method of displaying an article, comprising the steps of:

a) providing a generally rectangular protective enclosure sized to permit the enclosure to be substituted for a selected generally rectangular ceiling tile in a suspended ceiling, wherein the enclosure has a generally rectangular bottom wall member that defines a substantially transparent window through which an article to be displayed can is viewable when in a display position atop the bottom wall member, and has a top wall member configured to overlie the article to be displayed when in the display position to define a display space between central regions of the top and bottom wall members, and wherein the enclosure further includes means for cooperating with peripheral portions of the top and bottom wall members in regions of the top and bottom wall members that surround the central regions of the top and bottom wall members 1) to permit the top and bottom wall members to be moved apart to open the display space for the insertion thereinto and the removal therefrom of the article, 2) to connect the peripheral portions of the top and bottom wall members, and 3) to minimize the flow of ambient air through the display space;

b) positioning the article in the display space defined between the central regions of the bottom and top wall members of the protective enclosure, with the top and bottom wall members being connected by said means to minimize the flow of ambient air through the display space; and, c) substituting the protective enclosure constaining the article in the display space thereof for the selected ceiling tile in the suspended ceiling so that the article is viewable through the window of the bottom wall member.

32. A method of protectively displaying a substantially flat surface of an article in a room having a ceiling that is defined at least in part by a grid of support members that provide upwardly facing support surfaces that extend perimetrically about generally rectangular openings for underlying and supporting peripheral portions of generally rectangular ceiling tile sized to fit the openings, comprising the steps of:

a) selecting a particular one of the ceiling tile to be removed from a particular one of the openings, wherein the selected particular ceiling tile has a length and a width, and removing the selected particular ceiling tile from the particular opening;

b) providing a generally rectangular display enclosure having a generally rectangular bottom wall that defines a transparent window through which contents of the display enclosure can be viewed, and a generally rectangular top wall, wherein the top and bottom walls have overlying peripheral regions that are configured to engage in a substantially contiguous and uninterrupted manner as the peripheral regions extend about central regions of the top and bottom walls, wherein the central regions of the top and bottom walls are spaced apart to define therebetween a display space that is surrounded by the overlying peripheral regions of the top and bottom walls;

c) providing means for releasably maintaining the peripheral regions of the top and bottom walls in substantially contiguous and uninterrupted engagement to substantially close the display space to a flow of ambient air therethrough, and for permitting the top and bottom walls to move apart to open the display space to permit a substantially flat article to be inserted thereinto and to be removed therefrom;

d) opening the display space, inserting into the display space the substantially flat article to be protectively displayed, with the flat surface of the article that is to be seen being visible through the transparent window defined by the bottom wall of the display enclosure, and closing the display space to enclose the article therein and to substantially prevent a flow of ambient air therethrough; and, d) installing the display enclosure in the particular opening with the peripheral portions of the bottom wall supported by such ones of the upwardly facing support surfaces as extend perimetrically about the particular opening.

* * * * *